United States Patent [19]

Billington et al.

[11] 4,434,088

[45] Feb. 28, 1984

[54] DETERGENT COMPOSITIONS CONTAINING SULPHOSUCCINATES AND HIGH BLOOM GEL STRENGTH PROTEIN

[75] Inventors: Reginald Billington, Birkenhead; David J. Edge, Chester; Peter Winterbotham, Wirral, all of England

[73] Assignee: Lever Brothers Company, New York, N.Y.

[21] Appl. No.: 400,793

[22] Filed: Jul. 22, 1982

[30] Foreign Application Priority Data

Jul. 24, 1981 [GB] United Kingdom ..... 8122832

[51] Int. Cl.[3] ..... C11D 1/83; C11D 3/26

[52] U.S. Cl. ..... 252/547; 252/548; 252/550; 252/551; 252/552; 252/554; 252/555; 252/557; 252/558; 252/DIG. 14

[58] Field of Search ..... 252/538, 557, DIG. 13, 252/DIG. 14, 354, 550, 551, 547, 548, 552, 554, 555, 558; 560/151; 424/359

[56] References Cited

U.S. PATENT DOCUMENTS

| | | | |
|---|---|---|---|
| 2,028,091 | 1/1936 | Jaeger | 252/557 X |
| 3,689,419 | 9/1972 | Yueh | 252/90 |
| 3,898,186 | 8/1975 | Mermelstein et al. | 252/528 |
| 3,963,649 | 6/1976 | Spadini et al. | 252/546 |
| 4,040,989 | 8/1977 | Renaud et al. | 252/548 |
| 4,072,632 | 2/1978 | Reed | 252/541 |
| 4,079,020 | 3/1978 | Mills et al. | 252/547 |
| 4,144,201 | 3/1979 | Winterbotham et al. | 252/547 |
| 4,235,752 | 11/1980 | Rosall et al. | 252/551 |

FOREIGN PATENT DOCUMENTS

| | | |
|---|---|---|
| 1500775 | 10/1967 | France . |
| 1160485 | 8/1969 | United Kingdom . |
| 1160458 | 8/1969 | United Kingdom . |
| 1429637 | 3/1976 | United Kingdom . |

OTHER PUBLICATIONS

Encyclopaedia of Polymer Science and Technology, edited by H. F. Mark and N. G. Gaylord, vol. 7, pp. 456–457 (Wiley–Interscience).

*Primary Examiner*—P. E. Willis, Jr.

*Attorney, Agent, or Firm*—Milton L. Honig; James J. Farrell

[57] ABSTRACT

The foaming performance in hard water of dishwashing detergent compositions containing dialkyl sulphosuccinates is enhanced by including in the composition a substantially water-soluble protein having a Bloom gel strength of at least 50 g, preferably from 150 to 300 g and especially from 200 to 250 g. The protein is advantageously a gelatin.

10 Claims, No Drawings

DETERGENT COMPOSITIONS CONTAINING SULPHOSUCCINATES AND HIGH BLOOM GEL STRENGTH PROTEIN

The present invention relates to detergent compositions especially, but not exclusively, suitable for use in dishwashing operations in both hard and soft water.

The term "dishes" as used herein means any utensils involved in food preparation or consumption which may be required to be washed to free them from food particles and other food residues, greases, proteins, starches, gums, dyes, oils and burnt organic residues.

Light-duty liquid detergent compositions such as are suitable for use in washing dishes are well known. Most of the formulations in commercial use at the present time are based on anionic synthetic detergents with or without a nonionic detergent. Many of such formulations contain a sulphonate-type anionic detergent, for example, an alkylbenzene sulphonate or an alkane sulphonate, in conjunction with a sulphate-type anionic detergent, for example, an alkyl sulphate or an alkyl ether sulphate, or a nonionic detergent, for example, an alcohol ethoxylate, an alkyl phenol ethoxylate, a mono- or diethanolamide or an amine oxide. The sulphonate material generally predominates.

Virtually all the sulphonate-type and sulphate-type anionic detergents have the disadvantage that they are deactivated to a certain extent by protein. Since protein generally constitutes from 5 to 25% of the natural soils encountered in dishwashing this can mean that the efficiency of dishwashing liquids can be seriously reduced in practice.

We have now surprisingly discovered that the foaming and cleaning performance of one class of anionic detergents, the dialkyl sulphosuccinates, in hard water conditions is actually enhanced by the presence of certain types of protein.

Accordingly the present invention provides a detergent composition suitable for dishwashing, especially hand dishwashing, which comprises at least one detergent-active dialkyl sulphosuccinate and at least one substantially water-soluble protein having a Bloom gel strength of at least 50 g.

The detergent composition of the invention is preferably a liquid.

Detergent-active dialkyl sulphosuccinates are compounds of the formula I:

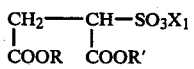

$$\begin{array}{l} CH_2 - CH - SO_3X_1 \\ \quad | \qquad\quad | \\ COOR \quad COOR' \end{array} \qquad (I)$$

wherein each of R and R', which may be the same or different, is a straight-chain or branched-chain alkyl groups having from 3 to 12 carbon atoms, and $X_1$ represents a solubilising cation.

By "solubilising cation" is meant any cation yielding a salt of the formula I sufficiently soluble to be detergent-active. The solubilising cation $X_1$ will generally be monovalent, for example, alkali metal, especially sodium; ammonium; or substituted ammonium, for example, ethanolamine. However, certain divalent cations, notably magnesium, are also suitable. For convenience the compounds of the formula I will be hereinafter referred to merely as dialkyl sulphosuccinates, but it is to be understood that this term is intended to refer to the salts of solubilising cations.

Dialkyl sulphosuccinates in general are known surface-active and detergent-active materials, described, for example, in U.S. Pat. No. 2,028,091 (American Cyanamid). The use of certain dialkyl sulphosuccinates in hand dishwashing compositions is disclosed, for example, in GB No. 1 429 637 (Unilever), which describes and claims such compositions containing water-soluble salts of di($C_7$–$C_9$) alkyl esters of sulphosuccinic acid in conjunction with alkyl sulphates or alkyl ether sulphates.

GB No. 1 160 485 (Colgate-Palmolive) discloses a composition comprising an inert solvent having incorporated therein a water-soluble surface-active agent and a water-soluble partially degraded protein having a gel strength of zero Bloom grams. The presence of the partially degraded protein is said to reduce irritation of the skin by the composition. The surface-active agent may be inter alia the sodium salt of dioctyl sulphosuccinate. The partially degraded protein may be a water-soluble enzymatic hydrolysis product of a protein, such as proteose peptone; or a heat-derived decomposition product of a protein.

The Bloom gel strength is a measure of the ability of a material to form a gel and is measured on an apparatus known as the "Bloom-gel-o-meter" in Bloom grams. The test is described in encyclopaedia of Polymer Science and Technology, edited by H F Mark and N G Gaylord, (Wiley-Interscience), Volume 7, pages 456–457. The Bloom gel strength is the weight in grams required to depress the gel a distance of 4 mm with a piston having a cross-sectional area of 1 $cm^2$, the gel having first been cooled for a defined time under defined conditions. Thus the higher the Bloom value of a material the greater the ability of that material to form a gel.

The protein used in the present invention preferably has a gel strength of 150 to 300 g, more preferably 200 to 250 g.

According to a preferred embodiment of the invention, the protein is gelatin. Gelatins having Bloom gel strengths of 200 g and 250 g have been found to give substantial enhancement of the performance of dialkyl sulphosuccinate-based detergent compositions.

The amount of protein present is preferably within the range of from 1 to 50% by weight, based on total detergent-active material, preferably from 5 to 20% by weight.

The presence of protein as specified above in the detergent compositions of the invention has been found to increase foaming performance significantly, especially in hard water. The addition of protein to conventional dishwashing detergents based on alkylbenzene sulphonates, on the other hand, does not lead to a similar enhancement of performance. Furthermore, the addition of zero Bloom strength partially degraded proteins as disclosed in GB No. 1 160 485 to detergent compositions based on dialkyl sulphosuccinates gives a very much smaller enhancement of performance.

The detergent composition of the invention preferably includes at least one sulphosuccinate in which at least one of the R groups has from 6 to 10 carbon atoms, more preferably from 7 to 9 carbon atoms.

Combinations of sulphosuccinates as disclosed in our co-pending applications of even date entitled "Detergent Compositions", U.S. patent application Ser. Nos. 400,829 and 400,795 are especially advantageous, as are the novel sulphosuccinates disclosed in our co-pending application of even date entitled "Novel sulphosuccinates and detergent compositions containing them" U.S. patent application Ser. No. 400,794.

Even when other detergent-active materials are present the addition, according to the invention, of the specified protein to sulphosuccinate-containing dishwashing compositions can give improved performance, for example, protein may with advantage be added, according to the present invention, to the compositions of GB No. 1,429,637 mentioned above.

Dialkyl sulphosuccinates also possess other advantages over the sulphonate-type anionic detergents conventionally used in dishwashing compositions. Alkylbenzene sulphonates and alkane sulphonates are produced by sulphonation of petrochemically derived hydrocarbons and consist of a mixture of materials of different chain lengths and sulphonate group substitution, only some of which contribute to the cleaning and foaming performance of the product, different materials being useful at different water hardnesses. The chemistry of manufacture of these materials allows at best limited control of the isomer distribution in the product alkylbenzene sulphonates and secondary alkane sulphonates.

Dialkyl sulphosuccinates, on the other hand, may be manufactured from alkanols, which are commercially available as materials of strictly defined chain length: thus the chain length of the sulphosuccinates may be precisely controlled.

Detergent compositions according to the invention may if desired contain other detergent-active agents as well as dialkyl sulphosuccinates. These are preferably anionic or nonionic, but may also be cationic, amphoteric or zwitterionic. The weight ratio of total sulphosuccinate to other detergent-active material may range, for example, from 99:1 to 1:99.

If desired, sulphosuccinates may be used in conjunction with other anionic detergents, for example, alkylbenzene sulphonates, secondary alkane sulphonates, α-olefin sulphonates, alkyl glyceryl ether sulphonates, primary and secondary alkyl sulphates, alkyl ether sulphates, and fatty acid ester sulphonates; or with nonionic detergents such as ethoxylated and propoxylated alcohols and ethoxylated and propoxylated alkyl phenols. These materials are well known to those skilled in the art. Materials such as amine oxides and mono- and dialkanolamides, which may be regarded either as nonionic surfactants or as foam boosters, may also be present additionally or alternatively. These materials too are well known to those skilled in the art.

Combinations of sulphosuccinates with certain other detergent-active materials, notably alkyl ether sulphates and nonionic detergents (alkoxylated alcohols) are especially preferred. The ratio of total sulphosuccinate to these other materials is preferably within the range of from 1:4 to 20:1, more preferably from 1:1 to 12:1.

Preferred alkyl ether sulphates are primary and secondary alcohol ethoxy sulphates represented by the general formula $R_1—O—(C_2H_4O)_n—SO_3M$, in which $R_1$ represents an alkyl group having 10 to 18 carbon atoms, the degree of ethoxylation n is from 1 to 12, and M represents an alkali metal, an ammonium or an amine cation. The R group more preferably contains 10 to 15 carbon atoms, and n is more preferably from 1 to 8. In any commercially available ether sulphate, there will of course be a spread of degree of ethoxylation, and n will represent an average value. An example of a suitable amine cation M is the monoethanolamine cation.

Preferred nonionic detergents are in particular the condensates of straight or branched chain primary or secondary aliphatic alcohols with ethylene oxide, of the general formula $R_2—O—(C_2H_4O)_mH$, in which $R_2$ is an alkyl group having from 8 to 20 carbon atoms, preferably from 8 to 12 carbon atoms, and m, the average degree of ethoxylation, ranges from 5 to 20.

Other suitable nonionic detergents include nonionic alkylphenol polyethers of the general formula $R_3—C_6H_4—O—(C_2H_4O)_xH$, where $R_3$ is an alkyl group having from 6 to 16 carbon atoms, preferably 8 to 12 carbon atoms, and the average degree of ethoxylation x is from 8 to 16, preferably 9 to 12; and nonionic condensates of fatty acids and ethylene oxide of the general formula $R_4—CO—O—(C_2H_4O)_yH$, where $R_4$ is an alkyl group having from 12 to 18 carbon atoms, and the average degree of ethoxylation y is from 8 to 16.

As previously mentioned, the detergent compositions of the invention are preferably liquids, although dialkyl sulphosuccinates are themselves solids at ambient temperature. The detergent compositions of the invention may, however, be in any suitable physical form, for example, powders, solid bars or gels.

The sulphosuccinate materials with which the invention is concerned are however outstandingly suitable for incorporation in liquid products, with or without other detergent-active materials. These liquid detergent products may be used for all normal detergent purposes, for example, as fabric washing liquids, both built and unbuilt, for both heavy-duty laundry and for washing delicate fabrics; as personal washing products ("liquid soap"), as shampoos, as car wash products, or as foam bath products. They are, however, of especial interest in products for dishwashing, especially for hand dishwashing. These liquid products may range from concentrates, containing virtually 100% active detergent, to the more dilute aqueous solutions seen by the consumer. In the latter type of product the total amount of detergent-active material will generally range from 2 to 60% by weight, the balance being made up by water; minor ingredients such as perfume, colour, preservatives, germicides and the like; and, if necessary, a viscosity and solubility control system, referred to in the art as a hydrotrope.

The hydrotrope system, for example, may comprise any one or more of the following materials: lower alcohols, especially ethanol; urea; and lower mono- or dialkylbenzene sulphonates, such as sodium or ammonium xylene sulphonates or toluene sulphonates.

The invention is further illustrated by the following non-limiting Examples.

EXAMPLES

The dishwashing performances of various sulphosuccinate-based compositions according to the invention were compared with others without protein, by means of a modified Schlachter-Dierkes test based on the principle described in *Fette und Seifen* 1951, 53, 207. A 100 ml aqueous solution of each material tested, having a concentration of 0.05% active detergent, in 24°H water (French hardness, i.e. 24 parts calcium carbonate per 100,000 parts water) at 45° C. was rapidly oscillated using a vertically oscillating perforated disc within a graduated cylinder. After the initial generation of foam, increments (0.2 g) of soil (9.5 parts commercial cooking fat, 0.25 parts oleic acid, 0.25 parts stearic acid and 10 parts wheat starch in 120 parts water) were added at 15-second intervals (10 seconds' mild agitation and 5 seconds' rest) until the foam collapsed. The result was recorded as the number of soil increments (NSI score): under the conditons used an alkylbenzene sulphonate was found to give a score of about 20 (see Example 3), and a 4:1 alkylbenzene sulphonate/alkyl ether sulphate mixture, conventional for dishwashing, gave a score of 49 (see Example 4). A score difference of 6 or less is generally regarded as insignificant. Each result was the average of 4 runs.

EXAMPLE 1

The effect of adding various amounts of gelatin to two different dialkyl sulphosuccinate systems was measured. The gelatin used was soluble gelatin powder ex British Drug Houses Ltd, believed to have a Bloom gel strength of about 250 g. The percentages of protein shown are based on the total sulphosuccinate material present.

The dialkyl sulphosuccinates used were disodium di-n-octyl sulphosuccinate and a mixture of disodium di-n-hexyl sulphosuccinate and disodium n-hexyl n-octyl sulphosuccinate. The two symmetrical sulphosuccinates were prepared as described in Example 6 of our co-pending application of even date entitled "Detergent Compositions" (U.S. application Ser. No. 400,829), and the n-hexyl n-octyl sulphosuccinate was prepared as described in Example 4 of that application.

| Sulphosuccinate system (mole ratio where shown) | NSI scores at gelatin levels of | | | |
|---|---|---|---|---|
| | 0 | 1% | 5% | 20% |
| $diC_8$ | 1 | 1 | 8 | 24 |
| $diC_6 + C_6/C_8$ 1:2 | 36 | 32 | 44 | 83 |

In the case of the $diC_8$ compound which has a very poor performance at zero protein in 24°H hard water, a relatively high level of protein (20%) is needed to raise the performance to an acceptable level. The second system, which already gives a better than acceptable score at zero protein, gives even better scores in the presence of gelatin, and its extraordinarily high score at 20% gelatin will be noted.

EXAMPLE 2

The procedure of Example 1 was repeated using a number of different detergent-active systems.

The proteins used were as follows:

Soluble gelatin ex British Drug Houses Ltd (believed to have a Bloom gel strength of about 250 g)

200-Bloom acid gelatin

250-Bloom limed gelatin

Zero-Bloom gelatin

Proteose peptone (believed to have a Bloom gel strength of zero).

The results are shown in Table 1, in which the detergent-active systems used are abbreviated as follows:

ABS: linear $C_{10}$–$C_{12}$ alkylbenzene sulphonate, sodium salt (Dobs (Trade Mark) 102 ex Shell)

$diC_6+diC_8$: a 1:1 molar mixture of di-n-hexyl sulphosuccinate and di-n-octyl sulphosuccinate (sodium salts)

$C_6/C_8$ pure: n-hexyl n-octyl sulphosuccinate (sodium salt), prepared as in Example 4 of our copending application of even date (U.S. application Ser. No. 400,829)

$C_6/C_8$ stat. mix: a 1:2:1 molar mixture of di-n-hexyl sulphosuccinate, n-hexyl n-octyl sulphosuccinate and di-n-octyl sulphosuccinate (sodium salts), prepared as described in Example 1 of our copending application of even date (U.S. application Ser. No. 400,829).

It will be noted that all three high Bloom strength gelatins give improved scores with the sulphosuccinate systems. With the alkylbenzene sulphonate, neither the 200-Bloom acid gelatin nor the 250-Bloom limed gelatin gives any improvement at a 5% level, whereas at the same level substantial improvements are obtained with both the $C_6/C_8$ sulphosuccinate compound and the statistical sulphosuccinate mix.

The zero-Bloom proteins have very little beneficial effect on performance, and with the two $C_6/C_8$ sulphosuccinate systems proteose peptone actually has a slightly detrimental effect.

TABLE 1

| | NSI scores for detergent-active at protein level (%) | | | | | | | | | |
|---|---|---|---|---|---|---|---|---|---|---|
| | ABS | | $diC_6 + diC_8$ | | | | $C_6/C_8$ pure | | $C_6/C_8$ stat mix | |
| Protein | 0 | 5 | 0 | 2 | 5 | 0 | 0 | 5 | 0 | 5 |
| Gelatin powder | — | — | 13 | 43 | 5 | 73 | — | — | — | — |
| 200-Bloom acid gelatin | 21 | 21 | — | — | — | — | 62 | 107 | 61 | 112 |
| 250-Bloom acid gelatin | 20 | 22 | 14 | 42 | 57 | 80 | 62 | 91 | 62 | 101 |
| Zero-Bloom gelatin | — | — | 13 | 22 | 28 | 39 | — | — | — | — |
| Proteose peptone | 21 | 22 | 13 | — | 21 | 22 | 62 | 55 | 61 | 58 |

EXAMPLE 3

In this experiment the effect of adding high and low Bloom strength proteins to a mixed detergent system according to the invention, and to a comparison system, was investigated. The detergent system according to the invention was a 4:1 by weight mixture of a statistical $C_6/C_8$ sulphosuccinate mixture as used in Example 2 and a linear $C_{12}$–$C_{15}$ alkyl ether (3 EO) sulphate (Dobanol (Trade Mark) 25-3A ex Shell); and the comparison composition was a 4:1 mixture of the alkylbenzene sulphonate (Dobs 102) used in Example 2 and the same alkyl ether sulphate. The results are shown in Table 2.

TABLE 2

| | $C_6/C_8$ stat mix | | ABS | |
|---|---|---|---|---|
| Protein | 0 | 5% | 0 | 5% |
| 250-Bloom limed gelatin | 66 | 83 | 49 | 54 |
| Proteose Peptone | 66 | 66 | 49 | 50 |

Only the combination of sulphosuccinate and high Bloom strength gelatin shows a significant performance enhancement.

We claim:

1. A detergent composition suitable for dishwashing, which comprises:

(a) from 2 to 60% by weight of at least one detergent-active dialkyl sulphosuccinate of the formula I:

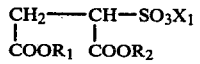

(I)

wherein each of $R_1$ and $R_2$, which may be the same or different, is straight-chain or branched chain alkyl group having from 3 to 12 carbon atoms, and $X_1$ represents a solubilising cation; and (b) from 5 to 20% by weight, based on total detergent-active material present of at least one substantially water-soluble protein having a Bloom gel strength of at least 50 g.

2. The detergent composition of claim 1, which includes at least one dialkyl sulphosuccinate of the formula I in which at least one of the groups $R_1$ and $R_2$ has from 6 to 10 carbon atoms.

3. The detergent composition of claim 1, which includes at least one dialkyl sulphosuccinate of the formula I in which at least one of the groups $R_1$ and $R_2$ has from 7 to 9 carbon atoms.

4. The detergent composition of claim 1, wherein the protein has a Bloom gel strength of from 150 to 300 g.

5. The detergent composition of claim 4, wherein the protein has a Bloom gel strength of from 200 to 250 g.

6. The detergent composition of claim 1, wherein the protein comprises gelatin.

7. The detergent composition of claim 1, which further comprises at least one anionic and/or nonionic detergent-active agent selected from the group consisting of alkylbenzene sulphonates, secondary alkyl sulphonates, α-olefin sulphonates, alkyl glyceryl ether sulphonates, primary and secondary alkyl sulphates, alkyl ether sulphates, fatty acid ester sulphonates, alcohol ethoxylates and propoxylates, alkyl phenol ethoxylates and propoxylates, alkyl amine oxides, and fatty acid mono- and dialkanolamides.

8. The detergent composition of claim 7, wherein the weight ratio of total sulphosuccinate to other detergent-active material is within the range of from 1:4 to 20:1.

9. The detergent composition of claim 1, which is in a liquid form.

10. The detergent composition of claim 1, which includes a viscosity control system comprising at least one material selected from the group consisting of lower alkanols, urea and the group consisting of lower alkylbenzene sulphonates.

* * * * *